US007924115B2

(12) United States Patent
Lee et al.

(10) Patent No.: US 7,924,115 B2
(45) Date of Patent: Apr. 12, 2011

(54) DPDT RF SWITCH AND TMA USING THE SAME

(75) Inventors: Kang-Hyun Lee, Gyeonggi-do (KR); Gil-Ho Lee, Gyeonggi-do (KR); Hyoung-Seok Yang, Gyeonggi-do (KR)

(73) Assignee: KMW Inc. (KR)

( * ) Notice: Subject to any disclaimer, the term of this patent is extended or adjusted under 35 U.S.C. 154(b) by 217 days.

(21) Appl. No.: 12/441,318

(22) PCT Filed: Dec. 22, 2006

(86) PCT No.: PCT/KR2006/005670

§ 371 (c)(1),
(2), (4) Date: Mar. 13, 2009

(87) PCT Pub. No.: WO2008/032906

PCT Pub. Date: Mar. 20, 2008

(65) Prior Publication Data

US 2009/0315639 A1 Dec. 24, 2009

(30) Foreign Application Priority Data

Sep. 15, 2006 (KR) ..... 10-2006-0089846

(51) Int. Cl.
*H01P 1/10* (2006.01)
*H01P 3/08* (2006.01)

(52) U.S. Cl. ..... 333/103; 333/121; 333/246

(58) Field of Classification Search ..... 333/101, 333/103, 104, 121, 122, 125, 246, 247
See application file for complete search history.

(56) References Cited

U.S. PATENT DOCUMENTS 4,575,701 A 3/1986 Greed
(Continued)

FOREIGN PATENT DOCUMENTS

JP 54-104719 A 8/1979
(Continued)

OTHER PUBLICATIONS

Supplementary European Search Report; Appln. No. 06835374.7; Oct. 2, 2009.
P. Bhartia, et al., Millimeter Wave Engineering and Applications, John Wiley & Sons, 1984, pp. 468-469 (see Figs. 8-37).

(Continued)

*Primary Examiner* — Dean O Takaoka
(74) *Attorney, Agent, or Firm* — Storm LLP

(57) ABSTRACT

Disclosed is a DPDT RF switch. The DPDT RF switch includes: first to fourth transmission lines for forming first to fourth ports, respectively; and first to fourth slot line pattern sections. The first slot line pattern section includes: a first slot line; and a first switching device for blocking signal transfer by short-circuiting a gap of a slot line. The third slot line pattern section includes: a third slot line; and a third switching device for blocking signal transfer by short-circuiting a gap of a slot line. The second slot line pattern section includes: a first loop-shaped slot line; a second slot line; and a second switching device for blocking signal transfer by short-circuiting a gap of a slot line. The fourth slot line pattern section includes: a second loop-shaped slot line; a fourth slot line; and a fourth switching device for blocking signal transfer by short-circuiting a gap of a slot line.

10 Claims, 2 Drawing Sheets

U.S. PATENT DOCUMENTS

| | | | | |
|---|---|---|---|---|
| 7,564,323 | B2 * | 7/2009 | Kim et al. | 333/103 |
| 7,605,674 | B2 * | 10/2009 | Kim | 333/103 |
| 2003/0122628 | A1 | 7/2003 | Aikawa et al. | |
| 2003/0183928 | A1 | 10/2003 | Miyazawa | |
| 2009/0206908 | A1 * | 8/2009 | Lee et al. | 327/403 |

FOREIGN PATENT DOCUMENTS

| | | | |
|---|---|---|---|
| JP | 60-172864 | A | 9/1985 |
| JP | 62-171202 | A | 7/1987 |
| JP | 10-284901 | A | 10/1998 |
| KR | 20-0309197 | Y1 | 3/2003 |

* cited by examiner

[Fig. 1]
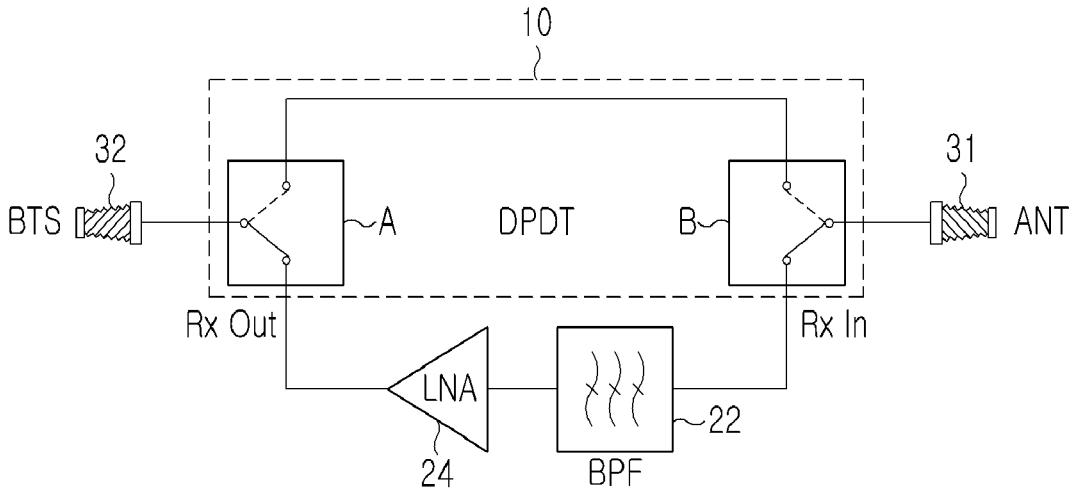
[Fig. 2]
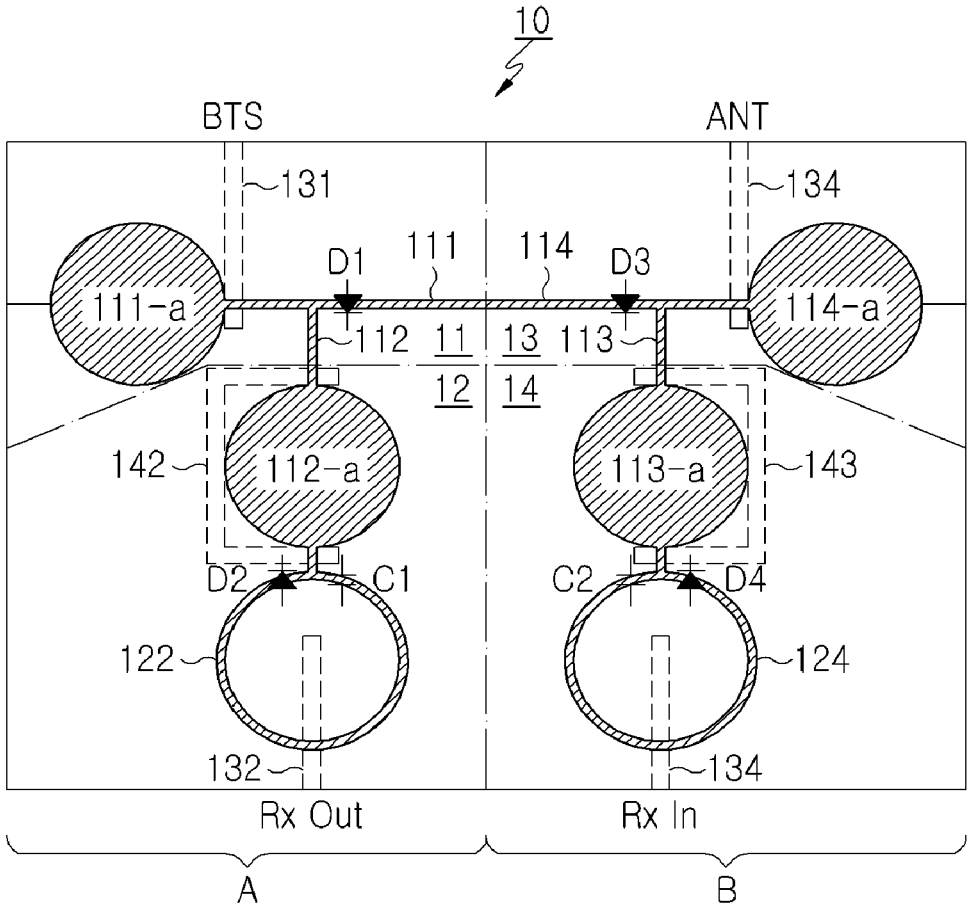

[Fig. 3]
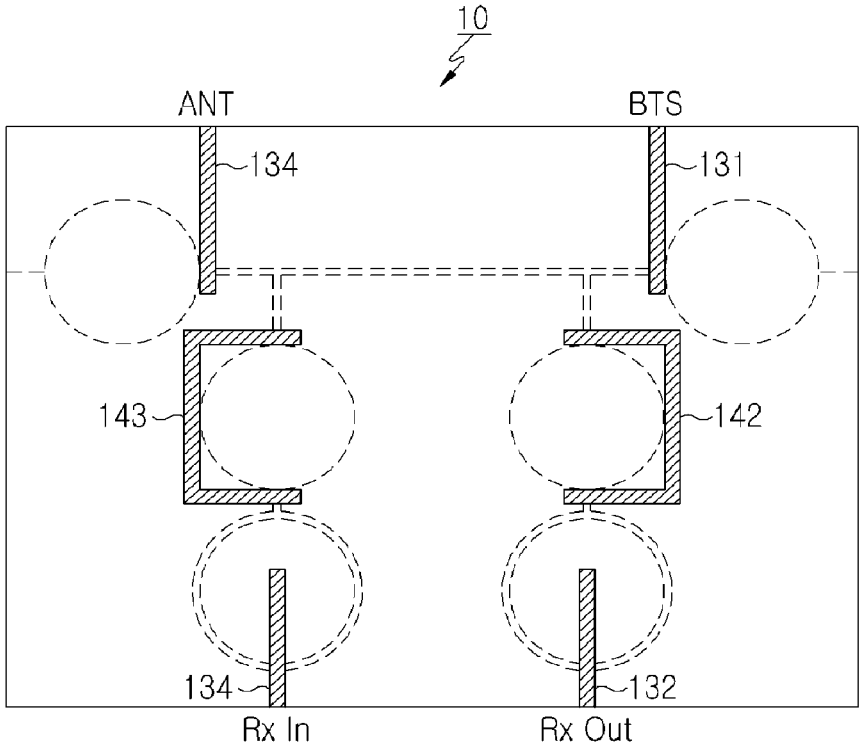
[Fig. 4]
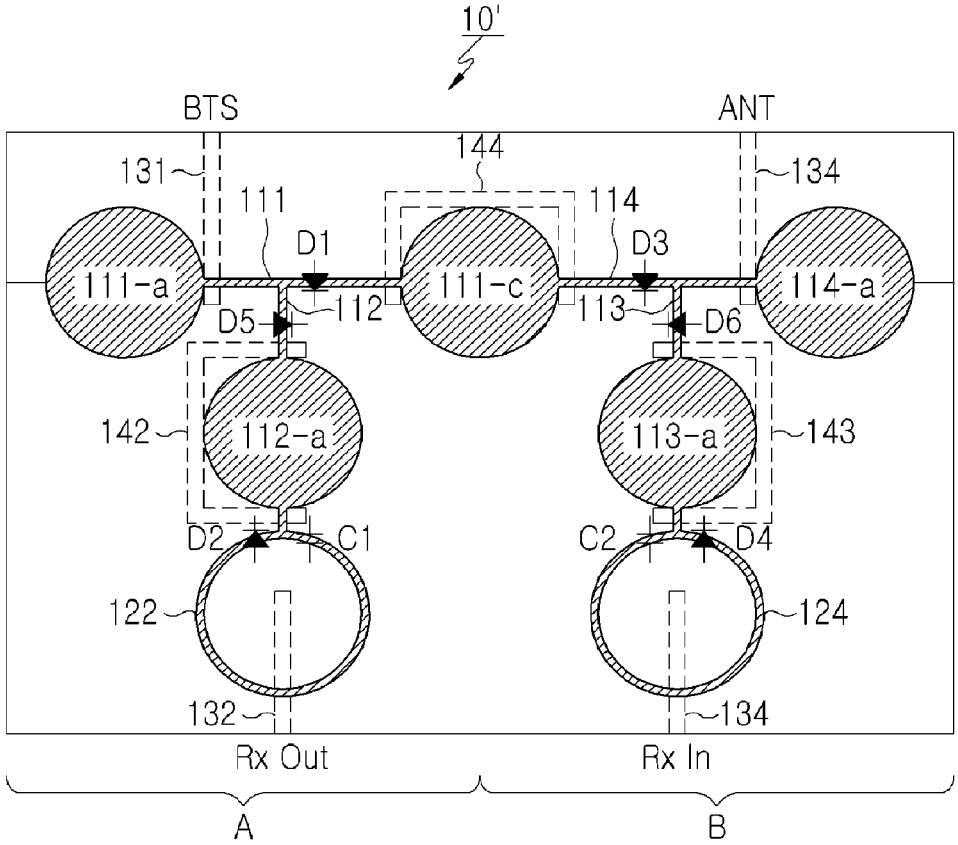

DPDT RF SWITCH AND TMA USING THE SAME

TECHNICAL FIELD

The present invention relates to a Radio Frequency (RF) switch, and more particularly to a Dual Pole Dual Throw (DPDT) RF switch, which can be applied to a switch for transmission/reception signal switching of a signal transmission/reception terminal in a Time Division Duplexing (TDD) system, and a Tower Mounted Amplifier (TMA) using the same.

BACKGROUND ART

A time division transmission scheme including a TDD scheme time-divides the same frequency and separately uses the divided frequencies for transmission/reception. That is, the time division transmission scheme divides one frame for transmission/reception and performs bidirectional communication through one frequency. Since a TDD system employing such a scheme separately performs transmission and reception through the same frequency according to a predetermined time period, a high speed RF switch for transmission/reception switching is essentially necessary.

Since the RF switch must perform a high speed switching operation, a switch using a semiconductor device such as a pin diode and a Field Effect Transistor (FET) is used instead of a mechanical switch. However, it is difficult to use such a switch using a semiconductor device as a switch for high power because a semiconductor is less tolerant to high power.

In other words, when high power is applied to the switch, much heat is generated. If sufficient protection against heat is not ensured, the switch may eventually be broken. Further, a RF switch developed to be tolerant to high power must have a separate refrigerator, etc., and thus becomes very expensive. In addition, it is difficult to manufacture the RF switch. Therefore, the RF switch is primarily used for military purposes only.

In order to solve this problem, the TDD system has employed a method for fixedly separating transmission signals from reception signals by using a circulator instead of the RF switch. However, in the case of using a circulator, it is difficult to sufficiently ensure isolation for blocking transmission signals during a reception interval. When an antenna enters an open state due to the occurrence of a problem in the antenna during the transmission of transmit power, transmission signals enter a receiver and thus abnormality may occur in the system, or the quality of reception signals may significantly deteriorate. Further, transmission Passive Intermodulation Distortion (PIMD) occurs and affects the radio wave quality of other communication providers.

DISCLOSURE OF INVENTION

Technical Problem

Accordingly, the present invention has been made to solve the above-mentioned problems occurring in the prior art, and it is an object of the present invention to provide a DPDT RF switch, which can be applied for transmission/reception switching of a TDD system in order to sufficiently ensure isolation between transmission and reception terminals, and a TMA using the same.

It is another object of the present invention to provide a DPDT RF switch, which can be applied for transmission/reception switching of a TDD system in order to significantly prevent transmit power from entering into a reception terminal even when abnormality occurs in a DC power supply for a control operation in a case where an antenna is opened, and a TMA using the same.

It is further another object of the present invention to provide a DPDT RF switch capable of stably operating with high power, and a TMA using the same.

It is still another object of the present invention to provide a DPDT RF switch which can be easily manufactured in the form of a Microwave Integrated Circuit (MIC), and a TMA using the same.

It is yet another object of the present invention to provide a DPDT RF switch which can be used in a high frequency band of more than several tens of GHz as well as a mobile communication frequency band, and a TMA using the same.

Technical Solution

In order to accomplish the aforementioned objects, according to an embodiment of the present, there is provided a Dual Pole Dual Throw (DPDT) Radio Frequency (RF) switch, the DPDT RF switch including: first to fourth transmission lines for forming first to fourth ports, respectively; and first to fourth slot line pattern sections in which signal transition with the first to fourth transmission lines is implemented, respectively, wherein the first to fourth slot lines are interconnected, wherein the first slot line pattern section includes: a first slot line for transferring signals to a signal transition point of the first transmission line, and a connection point with other slot line pattern sections; and a first switching device for blocking signal transfer by short-circuiting a gap of a slot line in an installation position according to external switching control signals, the first switching device being installed in a preset position of the first slot line, wherein the third slot line pattern section includes: a third slot line for transferring signals to a signal transition point of the third transmission lines, and a connection point with other slot line pattern sections; and a third switching device for blocking signal transfer by short-circuiting a gap of a slot line in an installation position according to external switching control signals, the third switching device being installed in a preset position of the third slot line, wherein the second slot line pattern section includes: a first loop-shaped slot line in which signal transition with the second transmission line is implemented at a first side of the second transmission line; a second slot line for transferring signals to a connection point of a second side of the first loop-shaped slot line and the slot line pattern sections; and a second switching device for blocking signal transfer by short-circuiting a gap of a slot line in an installation position according to the switching control signals, the second switching device being installed in at least one side of a connection portion of the first loop-shaped slot line and the second slot line, wherein the fourth slot line pattern section includes: a second loop-shaped slot line in which signal transition with the fourth transmission line is implemented at a first side of the fourth transmission line a fourth slot line for transferring signals to a connection point of a second side of the second loop-shaped slot line and the slot line pattern sections; and a fourth switching device for blocking signal transfer by short-circuiting a gap of a slot line in an installation position according to the switching control signals, the fourth switching device being installed in at least one side of a connection portion of the second loop-shaped slot line and the fourth slot line, wherein the second slot line is connected to the first slot line, the fourth slot line is connected to the third slot line, and the third slot line is connected to the first slot line, so that the first to fourth slot lines are eventually interconnected.

ADVANTAGEOUS EFFECTS

As described above, when a DPDT RF switch according to the present invention is employed as a transmission/reception switch of a TDD system, it is possible to further improve the isolation characteristic between transmission and reception terminals. Specifically, when an antenna is opened and abnormality has occurred in a DC power supply for control operation, it is possible to significantly prevent transmit power from entering into the reception terminal. In addition, the DPDT RF switch can stably operate with high power, can be easily manufactured, and can be used in a high frequency band of more than several tens of GHz.

BRIEF DESCRIPTION OF THE DRAWINGS

FIG. 1 is a block diagram illustrating the construction of a TMA module employing a DPDT RF switch according to one embodiment of the present invention;

FIGS. 2 and 3 are diagrams illustrating an upper surface and a lower surface of the circuit pattern of a DPDT RF switch on a Printed Circuit Board (PCB) according to a first embodiment of the present invention and FIG. 4 is a diagram illustrating one surface of the circuit pattern of a DPDT RF switch on a PCB according to a second embodiment of the present invention.

MODE FOR THE INVENTION

Hereinafter, preferred embodiments according to the present invention will be described with reference to the accompanying drawings. In the following description, many particular items, such as detailed elements, are shown, but these are provided for helping the general understanding of the present invention, and it will be understood by those skilled in the art that these particular items can be modified without departing from the spirit and scope of the present invention.

FIG. 1 is a block diagram illustrating the construction of a TMA module employing a DPDT RF switch according to one embodiment of the present invention. Referring to FIG. 1, the TMA of a mobile communication base station system is not installed inside a Base Transceiver Station (BTS), but installed on a steel tower on which a receiver antenna is located, which is referred to as a Tower-Top Amplifier (TTA) or a Tower-Top Low Noise Amplifier (TTLNA). Such a TMA has been designed in order to improve problems of cable noise and noise occurring in a path through which signals received in an antenna are transferred to a BTS signal processor. The TMA is constructed as one block including a Band Pass Filter (BPF) 22 for reception signals and a Low Noise Amplifier (LNA) 24, which are adjacent to a receiver antenna, the TMA being installed on a steel tower.

As illustrated in FIG. 1, such a TMA includes an antenna-side terminal 31 provided on a first side thereof, and a BTS-side terminal 32 provided on a second side thereof, wherein the antenna-side terminal 31 is connected to an antenna through a cable, and the BTS-side terminal 32 is connected to a BTS apparatus through a cable. Herein, a switch with a proper construction is provided in order to properly switch signals transmitted from the BTS apparatus and signals received in the antenna according to a transmission mode and a reception mode. This switch will be referred to as a DPDT switch 10 in the present invention.

The DPDT switch 10 according to the present invention performs a switching operation according to switching control signals provided by a controller (not shown) based on transmission and reception operations, thereby transferring transmission signals to the antenna (switching operation as indicated by dotted lines in FIG. 1). Further, the DPDT switch 10 provides the BPF 22 and the LNA 24 with reception signals received from the antenna, thereby transferring the signals having passed through the BPF 22 and the LNA 24 to the BTS apparatus (switching operation as indicated by solid lines in FIG. 1).

FIG. 2 is a diagram illustrating one surface (for convenience of description, referred to as an upper surface) of the circuit pattern of a DPDT RF switch on a PCB according to a first embodiment of the present invention, and FIG. 3 is a diagram illustrating the other surface (for convenience of description, referred to as a lower surface) of the circuit pattern of the DPDT RF switch according to the first embodiment of the present invention. The size and shape of each part are enlarged for convenience of description. Referring to FIGS. 2 and 3, the RF switch according to the first embodiment of the present invention includes a plurality of switching devices which are installed in a proper place among microstrip lines and slot lines, which are formed to have proper patterns on one dielectric substrate, and the patterns of a corresponding slot line, and which short-circuit the gap of a corresponding slot line according to external switching control signals, thereby blocking signal transfer.

That is, in the DPDT RF switch of the present invention, the first to fourth microstrip lines 131 to 134 of proper patterns forming the first to fourth ports of the DPDT RF switch are formed on the upper surface of the dielectric substrate. The first to fourth slot line pattern sections 11 to 14 are formed on the upper surface of the dielectric substrate in order to allow mutual signal transition to be implemented in a proper place due to the first to fourth microstrip lines 131 to 134 and microstrip line-to-slot line coupling. Such slot line patterns have a structure in which two T-junction slot lines are interconnected, and interconnected in a "□" shape. Herein, the first and second slot line pattern sections 11 and 12 are located in the upper left and lower left portions (part A in FIG. 2), respectively, in the "□" shaped connection structure. The third and fourth slot line pattern sections 13 and 14 are located in the upper right and lower right portions (part B in FIG. 2), respectively.

The first slot line pattern section 11 has an open termination circuit 111-*a* through which signal transition with the first microstrip line 131 is implemented, and has a first slot line 111 for transferring signals shifted from the first microstrip line 131 to connection points with the slot line pattern sections 12 to 14. The first slot line pattern section 11 includes a switching device (e.g. first diode D1) for blocking signal transfer by short-circuiting the gap of a corresponding slot line according to external switching control signals, the switching device being installed in a proper place of the first slot line 111. The termination of the first microstrip line 131 forms an open or short termination circuit. For example, when the termination of the first microstrip line 131 forms a short termination circuit, a circular hole through the substrate is formed in the termination thereof, the inside of the circular hole is plated by conductive metal, so that the circular hole can be connected to a ground plate in which the slot line patterns on the upper surface have been formed.

The second slot line pattern section 12 has a first loop-shaped slot line 122 through which signal transition with the second microstrip line 132 is implemented, and has a second slot line 112 for transferring signals shifted from the second microstrip line 132 to connection points with the slot line pattern sections 11, 13 and 14, more precisely, a connection points with the second slot line 112. Herein, a first subsidiary open termination circuit 112-*a* may be formed on the second slot line 112. In a portion through which the first subsidiary open termination circuit 112-*a* is connected to the second slot line 112, a first subsidiary microstrip line 142 is formed in a lower surface corresponding to the dielectric substrate, which has both sides allowing mutual signal transition to be implemented due to the second slot line 112 and microstrip line-to-slot line coupling. The first subsidiary open termination circuit 112-*a* and the first subsidiary microstrip line 142 improve the isolation characteristic in the second slot line when power is turned off.

The second slot line pattern section 12 includes a switching device for blocking signal transfer by short-circuiting the gap of a corresponding slot line according to external switching control signals, the switching device being installed in a proper place among corresponding slot line patterns. The switching device may include a second diode D2 for short-circuiting the gap of the first loop-shaped slot line 122 in a corresponding position, the second diode D2 being installed on one side of a connection portion of the first loop-shaped slot line 122 and the second slot line 112. A first capacitor C1 is installed to connect the gap of the first loop-shaped slot line 122 in a position corresponding to the installation position of the second diode D2 in the first loop-shaped slot line 122. In the second slot line pattern section 12, the second microstrip line 132 has an open portion with a length of $\lambda/8$ from the intersection of the first loop-shaped slot line 122, and a magnetic field for signal transition is maximized in this intersection. When the second diode D2 is in an off state, signals which can enter into the first loop-shaped slot line 122 from the second slot line 112 are distributed and transferred with a phase difference of 180□ along respective half-circular slot lines from the connection point with the second slot line 112. Then, the signals are offset in a point at which the distributed signals are gathered, i.e. a transition point with the second microstrip line 132, due to the mutual phase difference of 180□.

In the third and fourth slot line pattern sections 13 and 14, signal transition with the third and fourth microstrip lines 133 and 134 are implemented, respectively. The third and fourth slot line pattern sections 13 and 14 may have the same structures as those of the first and second slot line pattern sections 11 and 12, respectively. Herein, the first slot line 111 of the first slot line pattern section 11 is integrally connected to the third slot line 113 of the third slot line pattern section 13. As illustrated in FIGS. 2 and 3, the DPDT switch 10 according to the present invention may have a structure in which the left side is symmetrical to the right side.

Further, the switching control signals provided to the switching devices may turn on/off the operations of the switching devices by applying bias voltage of +5V/−5V through a ground substrate individually or properly and electrically separated from each switching device.

In the DPDT RF switch with the construction according to the present invention, the first to fourth ports of the first to fourth microstrip lines 131 to 134 are respectively connected to a BTS-side, the reception signal output terminal Rx Out of the LNA 24, the reception signal input terminal Rx In to the BPF 22, and the antenna, so that the DPDT RF switch can be used as the switching apparatus for transmission/reception switching of the TDD system.

Hereinafter, the operations of the DPDT RF switch having the construction as illustrated in FIGS. 2 and 3 as a transmission/reception switch of the TDD system will be described. First, in a transmission mode, the DPDT RF switch causes all switching devices to operate in an off state. If RF transmission signals are applied to the first port of the BTS-side, the transmission signals are transmitted to the third port of the antenna via the first microstrip line 131, the first and third slot lines 111 and 113, and the third microstrip line 133. Herein, signals which can enter into the second and fourth slot line pattern sections 12 and 14 are blocked by the structure of the first and second subsidiary open termination circuits 112-*a* and 113-*a*, the first and second subsidiary microstrip lines 142 and 143, and the first and second loop-shaped slot lines 122 and 124.

Next, in a reception mode, the DPDT RF switch causes all switching devices to operate in an on state. Reception signals are provided through the third port of the antenna via the third microstrip line 133 and the third slot line 113. The reception signals are not transmitted to the first slot line pattern section 11 because the first and third diodes D1 and D3 in an on state block signal transfer to the first and third slot lines 111 and 113. However, the reception signals enter into the second loop-shaped slot line 124 via the fourth slot line 114 and the second subsidiary microstrip lines 143 in the fourth slot line pattern section 14. The signals having entered into the second loop-shaped slot line 124 are shifted to the fourth microstrip line 134 because the fourth diode D4 is in an on state, and then provided to the fourth port of the reception signal input terminal Rx In toward the BPF 22.

Herein, the reception signals input to the third port of the reception signal output terminal Rx Out of the LNA 24 are transferred to the first loop-shaped slot line 122 and the second slot line 112 via an inverse process in the fourth slot line pattern section 14. Then, the signals are shifted to the first microstrip line 131 via the first slot line 111, and then provided to the first port of the BTS-side.

In the meantime, even when abnormality has occurred in a DC power supply for controlling the switching devices and thus all diodes enter an off state, the DPDT RF switch structure according to the present invention can ensure isolation of the reception signal input terminal Rx In and the reception signal output terminal Rx Out. That is, when abnormality has occurred in the DC power supply, signals which can enter into the second or fourth slot line pattern section 12 or 14 are blocked by the structure of the first and second subsidiary open termination circuits 112-*a* and 113-*a*, the first and second subsidiary microstrip lines 142 and 143, and the first and second loop-shaped slot lines 122 and 124, similarly to the transmission mode.

FIG. 4 is a diagram illustrating one surface of the circuit pattern of a DPDT RF switch on a PCB according to a second embodiment of the present invention. Referring to FIG. 4, the DPDT RF 10' switch according to the second embodiment of the present invention has a structure nearly similar to that the DPDT RF 10 switch according to the first embodiment as illustrated in FIGS. 2 and 3. That is, in order to improve the isolation characteristic, a third subsidiary open termination circuit 115-*a* is formed between first and third slot lines 111 and 113. In a portion through which the third subsidiary open termination circuit 115-*a* is connected to the first and third slot lines 111 and 113, a third subsidiary microstrip line 144 is formed in a lower surface corresponding to a dielectric substrate, which has both sides allowing mutual signal transition to be implemented due to the first and third slot lines 111 and 113 and microstrip line-to-slot line coupling. Further, switching devices, i.e. fifth and sixth diodes D5 and D6, are provided in second and fourth slot lines 112 and 114, and a ground substrate is properly and electrically separated so that switching control signals for controlling a switching operation can be provided to the switching devices.

The DPDT RF switch according to the second embodiment of the present invention as illustrated in FIG. 4 as a transmission/reception switch of the TDD system has operations and characteristics similar to those of the DPDT RF switch as illustrated in FIGS. 2 and 3. That is, in a transmission mode, the fifth and sixth diodes D5 and D6 operate in an on state (other diodes operate in an off state). In a reception mode, the fifth and sixth diodes D5 and D6 operate in an off state (other diodes operate in an on state). Accordingly, in the transmission mode, transmission signals are prevented from entering into the second and fourth slot lines 112 and 114 because the fifth and sixth diodes D5 and D6 are in an on state.

Although preferred embodiments of the present invention have been described for illustrative purposes, those skilled in the art will appreciate that various modifications, additions and substitutions are possible, without departing from the scope and spirit of the invention as disclosed in the accompanying claims, including the full scope of equivalents thereof. For example, the afore-described microstrip line can be replaced with a strip line, a coaxial line, a Coplanar Waveguide (CPW), etc. Further, a Coplanar Strip (CPS) can also be used instead of the slot line. In the above embodiments of the present invention, a diode is used as a switching device, but another semiconductor device (e.g. FET) having a switching function may also be used.

The invention claimed is:

1. A Dual Pole Dual Throw (DPDT) Radio Frequency (RF) switch, the DPDT RF switch comprising:

first to fourth transmission lines for forming first to fourth ports, respectively and first to fourth slot line pattern sections in which signal transition with the first to fourth transmission lines is implemented, respectively, wherein the first to fourth slot lines are interconnected, wherein the first slot line pattern section comprises:

a first slot line for transferring signals to a signal transition point of the first transmission line, and a connection point with other slot line pattern sections; and a first switching device for blocking signal transfer by short-circuiting a gap of a slot line in an installation position according to external switching control signals, the first switching device being installed in a preset position of the first slot line, wherein the third slot line pattern section comprises:

a third slot line for transferring signals to a signal transition point of the third transmission lines, and a connection point with other slot line pattern sections; and a third switching device for blocking signal transfer by short-circuiting a gap of a slot line in an installation position according to external switching control signals, the third switching device being installed in a preset position of the third slot line, wherein the second slot line pattern section comprises:

a first loop-shaped slot line in which signal transition with the second transmission line is implemented at a first side of the second transmission line a second slot line for transferring signals to a connection point of a second side of the first loop-shaped slot line and the slot line pattern sections; and a second switching device for blocking signal transfer by short-circuiting a gap of a slot line in an installation position according to the switching control signals, the second switching device being installed in at least one side of a connection portion of the first loop-shaped slot line and the second slot line, wherein the fourth slot line pattern section comprises:

a second loop-shaped slot line in which signal transition with the fourth transmission line is implemented at a first side of the fourth transmission line a fourth slot line for transferring signals to a connection point of a second side of the second loop-shaped slot line and the slot line pattern sections; and a fourth switching device for blocking signal transfer by short-circuiting a gap of a slot line in an installation position according to the switching control signals, the fourth switching device being installed in at least one side of a connection portion of the second loop-shaped slot line and the fourth slot line, wherein the second slot line is connected to the first slot line, the fourth slot line is connected to the third slot line, and the third slot line is connected to the first slot line, so that the first to fourth slot lines are eventually interconnected.

2. The DPDT RF switch as claimed in claim 1, wherein a first subsidiary open termination circuit is formed on the second slot line in the second slot line pattern section, a second subsidiary open termination circuit is formed on the fourth slot line in the fourth slot line pattern section, a first subsidiary microstrip line is formed in a connection portion of the first subsidiary open termination circuit and the second slot line, and has both sides allowing mutual signal transition to be implemented due to the second slot line and microstrip line-to-slot line coupling, and a second subsidiary microstrip line is formed in a connection portion of the second subsidiary open termination circuit and the fourth slot line, and has both sides allowing mutual signal transition to be implemented due to the fourth slot line and microstrip line-to-slot line coupling.

3. The DPDT RF switch as claimed in claim 1, wherein a third subsidiary open termination circuit is formed in a connection portion of the first and third slot lines, and a third subsidiary microstrip line is formed in a portion through which the third subsidiary open termination circuit is connected to the first and third slot lines, the third subsidiary microstrip line having both sides allowing mutual signal transition to be implemented due to the first and third slot lines and microstrip line-to-slot line coupling.

4. The DPDT RF switch as claimed in claim 1, wherein the second slot line includes a fifth switching device for blocking signal transfer by short-circuiting a gap of a slot line in an installation position according to the switching control signals, and the fourth slot line includes a sixth switching device for blocking signal transfer by short-circuiting a gap of a slot line in an installation position according to the switching control signals.

5. The DPDT RF switch as claimed in one of claims 1 to 4, wherein each of the first and fourth transmission lines includes one of a microstrip line, a strip line, a coaxial line and a Coplanar Waveguide (CPW).

6. A Tower Mounted Amplifier (TMA) using a Dual Pole Dual Throw (DPDT) Radio Frequency (RF) switch, the TMA comprising:

a Band Pass Filter (BPF) for reception signals;

a Low Noise Amplifier (LNA) for amplifying signals output from the BPF; and a RF switch for transmission/reception switching, wherein the RF switch comprises:

first to fourth transmission lines for forming first to fourth ports, respectively; and first to fourth slot line pattern sections in which signal transition with the first to fourth transmission lines is implemented, respectively, wherein the first to fourth slot lines are interconnected, wherein the first slot line pattern section comprises:

a first slot line for transferring signals to a signal transition point of the first transmission line, and a connection point with other slot line pattern sections; and a first switching device for blocking signal transfer by short-circuiting a gap of a slot line in an installation position according to external switching control signals, the first switching device being installed in a preset position of the first slot line, wherein the third slot line pattern section comprises:

a third slot line for transferring signals to a signal transition point of the third transmission lines, and a connection point with other slot line pattern sections; and a third switching device for blocking signal transfer by short-circuiting a gap of a slot line in an installation position according to external switching control signals, the third switching device being installed in a preset position of the third slot line, wherein the second slot line pattern section comprises:

a first loop-shaped slot line in which signal transition with the second transmission line is implemented at a first side of the second transmission line a second slot line for transferring signals to a connection point of a second side of the first loop-shaped slot line and the slot line pattern sections; and a second switching device for blocking signal transfer by short-circuiting a gap of a slot line in an installation position according to the switching control signals, the second switching device being installed in at least one side of a connection portion of the first loop-shaped slot line and the second slot line, wherein the fourth slot line pattern section comprises:

a second loop-shaped slot line in which signal transition with the fourth transmission line is implemented at a first side of the fourth transmission line a fourth slot line for transferring signals to a connection point of a second side of the second loop-shaped slot line and the slot line pattern sections; and a fourth switching device for blocking signal transfer by short-circuiting a gap of a slot line in an installation position according to the switching control signals, the fourth switching device being installed in at least one side of a connection portion of the second loop-shaped slot line and the fourth slot line, wherein the second slot line is connected to the first slot line, the fourth slot line is connected to the third slot line, and the third slot line is connected to the first slot line, so that the first to fourth slot lines are eventually interconnected, wherein first to fourth ports of the RF switch are respectively connected to a Base Transceiver Station (BTS)-side, a reception signal output terminal of the LNA, a reception signal input terminal to the BPF, and an antenna.

7. The TMA as claimed in claim 6, wherein a first subsidiary open termination circuit is formed on the second slot line in the second slot line pattern section, a second subsidiary open termination circuit is formed on the fourth slot line in the fourth slot line pattern section, a first subsidiary microstrip line is formed in a connection portion of the first subsidiary open termination circuit and the second slot line, and has both sides allowing mutual signal transition to be implemented due to the second slot line and microstrip line-to-slot line coupling, and a second subsidiary microstrip line is formed in a connection portion of the second subsidiary open termination circuit and the fourth slot line, and has both sides allowing mutual signal transition to be implemented due to the fourth slot line and microstrip line-to-slot line coupling.

8. The TMA as claimed in claim 6, wherein a third subsidiary open termination circuit is formed in a connection portion of the first and third slot lines, and a third subsidiary microstrip line is formed in a portion through which the third subsidiary open termination circuit is connected to the first and third slot lines, the third subsidiary microstrip line having both sides allowing mutual signal transition to be implemented due to the first and third slot lines and microstrip line-to-slot line coupling.

9. The TMA as claimed in claim 6, wherein the second slot line includes a fifth switching device for blocking signal transfer by short-circuiting a gap of a slot line in an installation position according to the switching control signals, and the fourth slot line includes a sixth switching device for blocking signal transfer by short-circuiting a gap of a slot line in an installation position according to the switching control signals.

10. The TMA as claimed in one of claims 6 to 9, wherein each of the first and fourth transmission lines includes one of a microstrip line, a strip line, a coaxial line and a Coplanar Waveguide (CPW).

* * * * *